United States Patent [19]

Gravereaux et al.

[11] 3,943,287

[45] Mar. 9, 1976

[54] APPARATUS AND METHOD FOR DECODING FOUR CHANNEL SOUND

[75] Inventors: Daniel W. Gravereaux, Wilton; Gerald A. Budelman, Bridgeport, both of Conn.

[73] Assignee: CBS Inc., New York, N.Y.

[22] Filed: June 3, 1974

[21] Appl. No.: 475,434

[52] U.S. Cl. ..... 179/1 GQ; 179/100.4 ST

[51] Int. Cl.[2] ..... H04H 5/00

[58] Field of Search ..... 179/1 G, 1 GQ, 100.4 ST, 179/15 BT

[56] References Cited

UNITED STATES PATENTS

| | | | |
|---|---|---|---|
| 3,786,193 | 1/1974 | Tsurushima | 179/1 GQ |
| 3,825,684 | 7/1974 | Ito et al. | 179/1 GQ |
| 3,829,615 | 8/1974 | Hiramatsu | 179/1 GQ |

*Primary Examiner*—Douglas W. Olms

*Attorney, Agent, or Firm*—Spencer E. Olson

[57] ABSTRACT

An apparatus and method for decoding four individual audio signals to the extent they are contained in first and second composite signals. The first composite signal contains the first individual audio signal in dominant proportion and two other individual audio signals in subdominant proportions. The second composite signal contains the second individual audio signals in dominant proportion and two other individual audio signals in subdominant proportions. In accordance with the invention there is provided a means for measuring the degree of directional predominance of each of the four individual audio signals. Means responsive to the composite signals are employed to form four partially decoded signals, each of the partially decoded signals including a different one of the individual audio signals in dominant proportion and two other individual audio signals in subdominant proportion. The four partially decoded signals are respectively applied to four output terminals. Further provided is a means responsive to the composite signals for forming four enhancement signals, each of the enhancement signals having a different one of the individual signals as its principal component. Each of the enhancement signals is applied to the particular ones of the output terminals at which its principal component is present in subdominant proportion. Each enhancement signal is applied at a relative phase which is the opposite of said signal present in subdominant proportion and at a level which depends on the measured degree of directional predominance of its principal component. In this manner, a selective cancellation of certain subdominant components is achieved.

10 Claims, 11 Drawing Figures

APPARATUS AND METHOD FOR DECODING FOUR CHANNEL SOUND

BACKGROUND OF THE INVENTION

This invention relates to audio systems and, more particularly, to an apparatus and method for decoding four individual audio signals contained in two composite signals, the decoding achieving an improved degree of quadraphonic realism when the decoded outputs are reproduced.

In the U.S. Pat. No. 3,708,631 there is the a sound system wherein four individual audio signals, designated $L_f$, $L_b$, $R_b$ and $R_f$ are encoded in accordance with the "SQ" quadraphonic technique to produce two composite signals designated $L_T$ and $R_T$. These two composite signals are typically transmitted over two lines, or recorded on and reproduced from two channel recording medium, such as a stereophonic disc record, and subsequently decoded into four simulated channels of sound by suitable decoding apparatus, a form of which is described in the referenced patent. In the SQ quadraphonic system, the composite signal $L_T$ contains, to thhe extent they are present, $L_f$ in a dominant proportion and $L_b$ and $R_b$ in subdominant proportions, $L_b$ and $R_b$ being phase shifted with respect to each other. Also, $R_T$ contains, to the extent they are present, $R_f$ in a dominant proportion and $L_b$ and $R_b$ in subdominant proportions, $L_b$ and $R_b$ being phase shifted with respect to each other. The referenced patent demonstrates that $L_T$ and $R_T$ can be decoded using an SQ decoder matrix to produce four signals which may be designated $L_f'$, $L_b'$, $R_b'$ and $R_f'$, each of these signals containing, in predominant proportion, a corresponding one of the four individual signals, along with certain "unwanted" components in subdominant proportions. These decoded signals are not "pure" or discrete original signals, each being "diluted" by two other signals. Nevertheless, when all four channels of the original program contain musical signals in concert, and the four decoded signals are reproduced over respective loudspeakers which are, for example, placed in the corners of a room or a listening area, then as far as the listener is concerned there is sufficient "mixing" of the sounds in the room that the resulting overall sound effect is quite similar to the sound of the original four discrete channels, and a credible simulation of the original four channel program results.

There are situations, however, in which it is desirable to provide an illusion of greater independence or purity of the decoded signals; for example, when the original sound is present in one or two channels only, it is desirable to enhance the separation of the channels which are present. Systems for achieving such audible spatial enhancement are described, for example, in the above-referenced U.S. Pat. No. 3,708,631 and the U.S. Pat. No. 3,784,744. It is an object of the present invention to obtain greater quadraphonic realism than that obtainable using previously described techniques.

SUMMARY OF THE INVENTION

The present invention is directed to an apparatus and method for decoding four individual audio signals, designated $L_f$, $L_b$, $R_b$ and $R_f$, to the extent they are contained in first and second composite signals, designated $L_T$ and $R_T$. The first composite signal, $L_T$, contains the first individual audio signal, $L_f$, in dominant proportion and two other individual audio signals, $L_b$ and $R_b$, in subdominant proportions. The second composite signal, $R_T$, contains the second individual audio signal, $R_f$, in dominant proportion and two other individual audio signals, $L_b$ and $R_b$, in subdominant proportions. In accordance with the invention there is provided a means for measuring the degree of directional predominance of each of the four individual audio signals. Means responsive to the composite signals are employed to form four partially decoded signals, designated $L_f'$, $R_f'$, $L_b'$ and $R_b'$, each of the partially decoded signals including a different one of the individual audio signals in dominant proportion and two other individual audio signals in subdominant proportion. The four partially decoded signals are respectively applied to four output terminals. Further provided is a means responsive to the composite signals for forming four enhancement signals, designated $L_f^-$, $R_f^-$, $L_b^-$ and $R_b^-$, each of the enhancement signals having a different one of the individual audio signals as its principal component. Each of the enhancement signals is applied to the particular ones of the output terminals at which its principal component is present in subdominant proportion. Each enhancement signal is applied at a relative phase which is the opposite of said signal present in subdominant proportion and at a level which depends on the measured degree of directional predominance of its principal component. In this manner, a selective cancellation of certain subdominant components is achieved.

In a preferred embodiment of the invention a plurality of control signals are generated as a function of the measured directional predominance of the four individual audio signals, and these control signals are utilized to modulate the level at which the enhancement signals are applied. Further features and advantages of the invention will become more readily apparent from the following detailed description when taken in conjunction with the accompanying drawings.

DESCRIPTION OF THE PREFERRED EMBODIMENT

Figure 1:
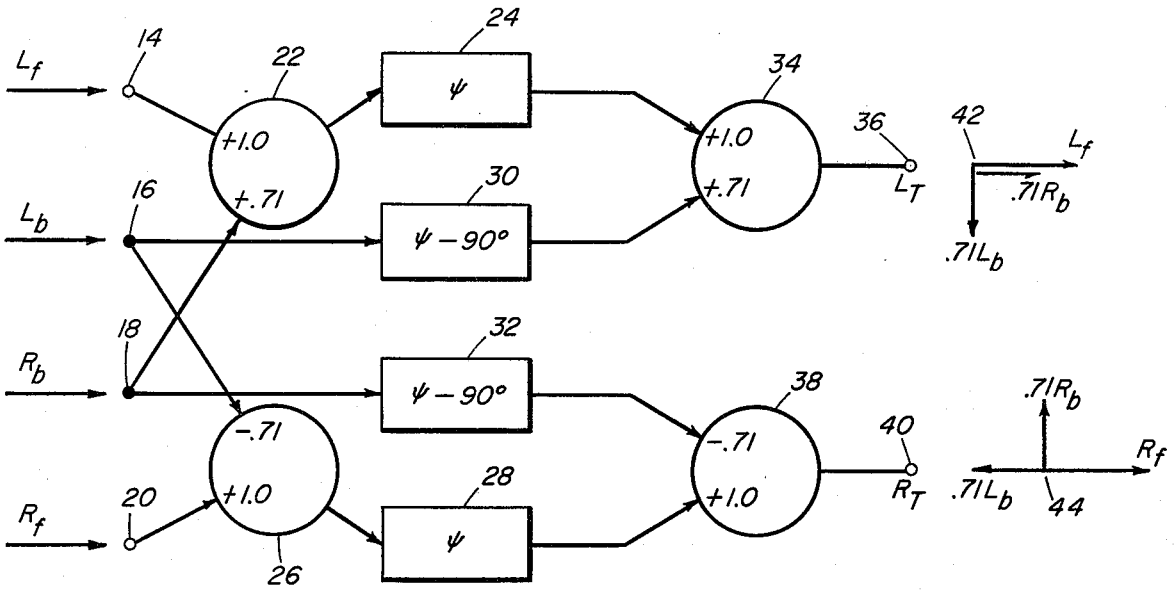
FIG. 1 shows an encoding matrix that is useful in understanding the present invention.

To facilitate understanding of the present invention it is helpful to first review certain aspects of the SQ type of quadraphonic system. FIG. 1 shows an encoding matrix of the type disclosed in my co-pending U.S. patent application Ser. No. 384,334 filed July 31, 1973, now U.S. Pat. No. 3,890,466 and assigned to the same assignee as the present application. The encoder of FIG. 1 has four input terminals, 14, 16, 18 and 20 through which four individual audio signals $L_f$, $L_b$, $R_f$ and $R_b$ are respectively applied. The full $L_f$ signal is added in a summing junction 22 to 0.71 of the $L_b$ signal, the output of the summing junction being applied to a phase shifting network 24 which introduces a reference phase shift $\psi$ that varies continuously with frequency. The full $R_f$ signal at terminal 20 is added in a second summing circuit 26 to −0.71 of the $L_b$ signal appearing at input terminal 16, and the output if passed through a second phase shifting network 28 which also provides a reference phase shift of $\psi$. The $L_b$ and $R_b$ signals are also applied to respective networks 30 and 32, each of which provides a phase shift of $(\psi - 90°)$ and wherein the $\psi$ functions are essentially the same. The full signal appearing at the output of network 24 is added in a summing circuit 34 to 0.71 of the signal appearing at the output of the network 30 to produce at its output terminal 36 a composite signal designated $L_T$. Similarly, the full signal from network 28 is added in summing junction 38 to −0.71 of the signal from network 32 to produce at its output terminal 40 a composite signal designated $R_T$. The composite signals $L_T$ and $R_T$ are conveniently characterized by the phasor groups 42 and 44, respectively.

The composite signals $L_T$ and $R_T$ are typically recorded on a two channel recording medium, such as a stereophonic disc record, and subsequently transduced and presented for decoding into four simulated channels of sound by suitable decoding apparatus.

Figure 2:
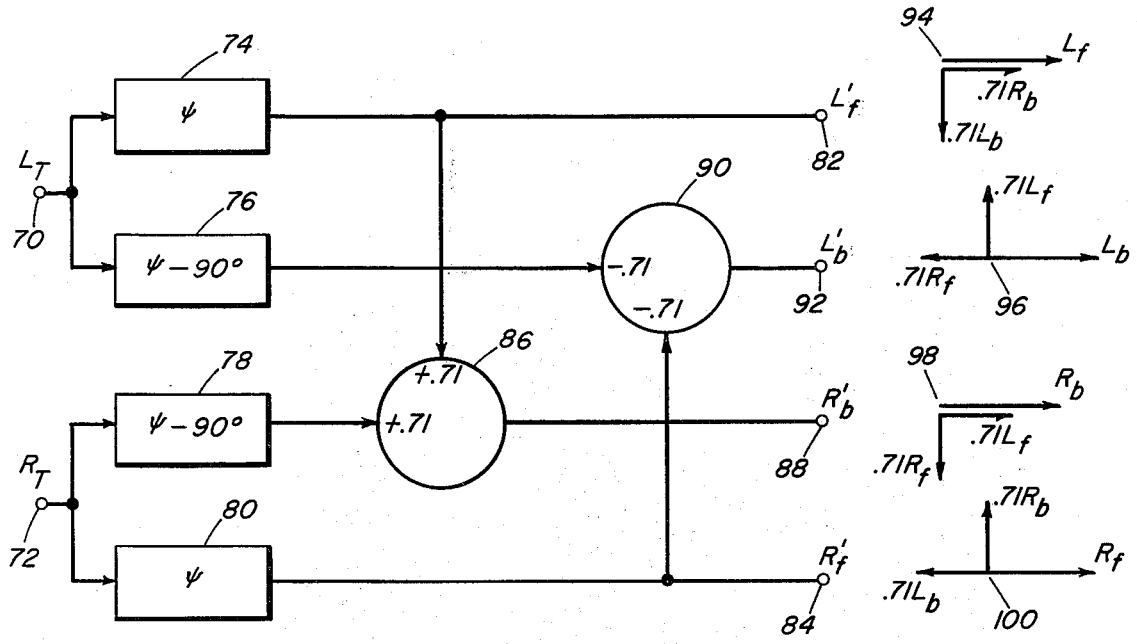
FIG. 2 shows a decoding matrix that is useful in understanding the present invention.

FIG. 2 illustrates a decoding matrix having characteristics described in detail in the co-pending U.S. patent application Ser. No. 338,691 filed Mar. 7, 1973, now U.S. Pat. No. 3,835,255 and assigned to the same assignee as the present application. The decoder of FIG. 2 includes a pair of input terminals 70 and 72 to which the composite signals $L_T$ and $R_T$ are respectively applied. The signal applied to terminal 70 is applied in parallel and phase shifted by a pair of phase shift networks 74 and 76, and the signal applied to input terminal 72 is applied in parallel to networks 78 and 80. The networks 74 and 80 introduce a phase shift of $\psi$ and the networks 76 and 78 introduce a phase shift of $(\psi - 90°)$. The output signals from networks 74 and 80 are respectively applied directly to the "left-front" output terminal 82 and to the "right-front" output terminal 84. Equal portions of the outputs of networks 74 and 78 are summed in a summing junction 86, the output of which is applied to the "right-back" output terminal 88 and equal portions of the output networks 76 and 80 are inverted and added in a second summing network 90, the output of which is applied to the "left-back" output terminal 92. As a result of the described phase shifting and summing action, four decoded signals designated $L_f'$, $L_b'$, $R_b'$ and $R_f'$, appear at output terminals 82, 92, 88 and 84, respectively, and have the composition depicted by phasor diagrams 94, 96, 98 and 100, respectively. It is seen that the predominant components in the four decoded signals, namely $L_f$, $L_b$, $R_b$ and $R_f$, have the same relative amplitude and phase as the corresponding signals applied to the encoder of FIG. 1, but that the predominant "front" components are accompanied by reduced amplitude components from the back pair of channels and the predominant "back" components are accompanied by reduced amplitude components from the front pair of channels.

Figure 3:
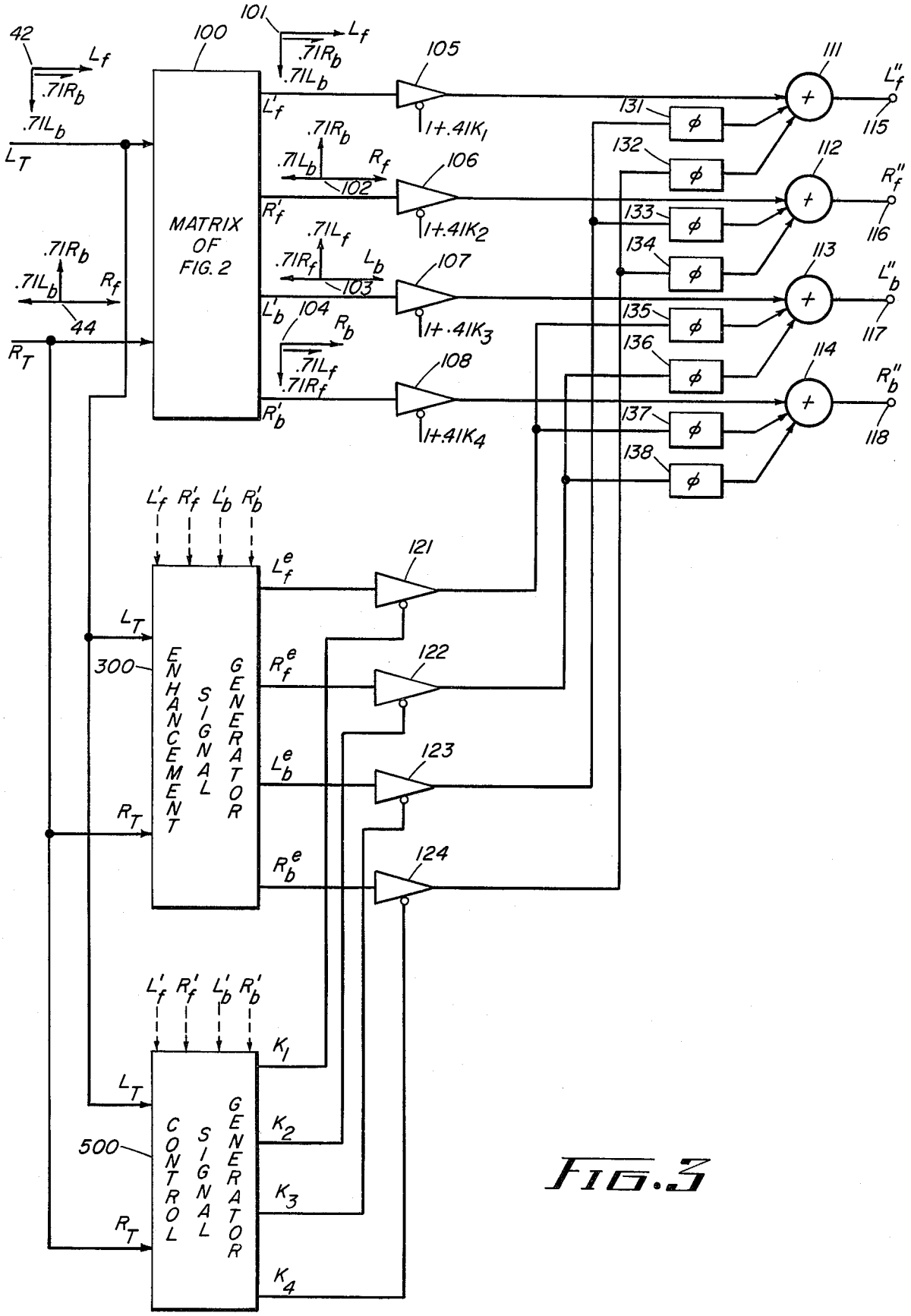
FIG. 3 is a simplified functional block diagram of a decoding apparatus in accordance with the invention.

Referring to FIG. 3, there is shown a simplified functional block diagram of a decoding apparatus in accordance with the invention. The composite signals $L_T$ and $R_T$, again represented by the phasor groupings 42 and 44, are applied in parallel to a matrix 100, an enhancement signal generator 300, and a control signal generator 500. The matrix 100 may be of the type shown in FIG. 2 and generates four signals $L_f'$, $R_f'$, $L_b'$ and $R_b'$, represented by the phasor groupings 101 through 104, respectively. For purposes of the present application, the outputs of matrix 100 shall be referred to as "partially decoded signals", since these standard SQ outputs are to be further enhanced in accordance with the present invention. The partially decoded signals $L_f'$, $R_f'$, $R_b'$ and $L_b'$ are coupled through gain control amplifiers 105, 106, 107 and 108, respectively, to four summing circuits labelled by the reference numerals 111, 112, 113 and 114, respectively. The outputs of summing circuits 111 through 114 are coupled to the output terminals 115 through 118, respectively, which, in turn, are typically coupled to four speakers (not shown) appropriately positioned in a listening area.

The enhancement signal generator 300 is responsive to the composite signals to generate four enhancement signals designated $L_f^e$, $R_f^e$, $L_b^e$, and $R_b^e$. The enhancement signals are characterized in that each one has a different one of the individual audio signals as its principal components; i.e., in dominant proportion. Specifically, $L_f^e$ includes $L_f$ as its principal component, $R_f^e$ includes $R_f$ as its principal component, $L_b^e$ includes $L_b$ as its principal component and $R_b^e$ includes $R_b$ as its principal component. Each of the enhancement signals also includes, in subdominant proportion, two other individual audio signals. Thus it is seen that the enhancement signals are similar in nature to the partially decoded signals ($L_f'$, $R_f'$, $L_b'$ and $R_b'$). In fact, in an embodiment of the invention the enhancement signals are the same as the partially decoded signals. In such case it is apparent that the outputs of matrix 100 can be used as the enhancement signals, and this situation is illustrated in FIG. 3 by showing the four partially decoded signals as dashed line inputs to the enhancement signal generator. The control signal generator 500 is responsive to $L_T$ and $R_T$ to generate as outputs four control signals designated $K_1$, $K_2$, $K_3$ and $K_4$. Once again, it will be appreciated that the control signal generator could alternatively be responsive to the partially decoded signals (again shown as dashed line inputs), but in such case the generator 500 would in essence be ultimately responsive to the composite signals $L_T$ and $R_T$ since the partially decoded signals are derived from these composite signals. Therefore, for purposes of this application, it will be understood that whenever the term "responsive to the composite signals" or a similar term is used, the intention is that this phrase includes cases where the responsive means is, in turn, responsive to signals derived from the composite signals.

The control signals $K_1$ through $K_4$ are a measure of the degree of directional predominance of each of the four individual audio signals; i.e., $K_1$ is a measure of the directional predominance of $L_f$, $K_2$ is a measure of the directional predominance of $R_f$, $K_3$ is a measure of the directional predominance of $L_b$, and $K_4$ is a measure of the directional predominance of $R_b$. The control signal generator may be of various types, for example the general type disclosed in U.S. Pat. No. 3,708,631 entitled "Quadraphonic Reproducing System With Gain Control". Techniques for the generation of control signals are also disclosed in the U.S. Pat. Nos.

2,784,777, 3,794,781 and 3,798,373.

The four enhancement signals, $L_f^e$, $R_f^e$, $L_b^e$ and $R_b^e$, are respectively coupled to four gain control amplifiers 121, 122, 123 and 124. The control signals are coupled to the control terminals of these amplifiers so that their gain is a function of the control signals. Specifically, amplifier 121 is controlled by signal $K_1$, amplifier 122 is controlled by signal $K_2$, amplifier 123 is controlled by signal $K_3$, and amplifier 124 is controlled by signal $K_4$. Each of the amplified enhancement signals is applied (via one of the adders 111 through 114) to the particular ones of the output terminals 115 through 118 at which its principal component is present in subdominant proportion. To illustrate, the enhancement signal $L_f^e$ has $L_f$ as its principal component. Therefore, the output of amplifier 121 is coupled to adders 113 and 114 since $L_f$ is present at these adders in subdominant proportion by virtue of the application of $L_b'$ and $R_b'$ to these adders. (Description of the purpose of amplifiers 105 through 108 shall be deferred to a later portion of this Specification, so for the present explanation these amplifiers can be considered as being short-circuited). The presence of $L_f$ in subdominant proportion in the signals $L_b'$ and $R_b'$ can be readily seen by examining the phasor groups 103 and 104. The enhancement signal $R_b^e$ has $R_b$ as its principal component. Therefore, the output of amplifier 124 is coupled to adders 111 and 112 since $R_b$ is present at these adders in subdominant proportion by virtue of the application of $L_f'$ and $R_f'$ to these adders. The presence of $R_b$ in subdominant proportions in the signals $L_f'$ and $R_f'$ can be readily seen by examining the phasor groups 101 and 102. In similar fashion, it is seen that the output of amplifier 122 is coupled to adders 113 and 114 while the output of amplifier 123 is coupled to adders 111 and 112.

Each of the amplified enhancement signals is applied to the appropriate adders in phase opposition with respect to the signals present in subdominant proportion at the adders. The function of applying the amplified enhancement signals at the appropriate phases is represented generally in FIG. 3 by the eight phase shifters labelled 131 through 138. To illustrate, it can be seen that the phase shifter 132 should introduce a relative phase shift of 180° to the amplified enhancement signal from amplifier 124. The enhancement signal $R_b^e$ has $R_b$ as its principal component. The partially decoded signal $L_f'$ includes an $R_b$ component in subdominant proportion (phasor group 101) and at an angle which can be arbitrarily called 0° (arrow pointing to the right). Accordingly, and assuming for the moment that the $R_b$ component of $R_b^e$ is also at 0°, it will be appreciated that the enhancement signal $R_b^e$ should be phase shifted by 180° (i.e., its polarity reversed) in order that its $R_b$ component be opposite in phase to the $R_b$ component of $R_f'$ so that the above-stated criterion is met. It will become apparent that this criterion tends to cause cancellation of the subdominant components of the partially decoded signals, the degree of cancellation depending upon the levels of the control signals $K_1$ through $K_4$. As a further illustration, the phase shifter 131 should introduce a relative phase shift of 90° component the amplified enhancement signal from amplifier 123. The enhancement signal $L_b^e$ has $L_b$ as its principal component and the partially decoded signal $L_f'$ includes a $L_b$ component in subdominant proportion (phasor group 101) and at a phase angle of 270° in accordance with the selected phase reference. Thus, again assuming that the $L_b$ component of $L_b^e$ is at 0°, it can be seen that $L_b^e$ should be phase shifted by 90° in order that its $L_b$ component be opposite in phase to the $L_b$ component of $L_f'$ whereby the stated criterion is again met.

In equation form, and using standard phasor notation, the partially decoded signals can be represented as follows:

$$L_f' = L_T = L_f + 0.71R_b - 0.71jL_b$$
$$R_f' = R_T = R_f - 0.71L_b + 0.71jR_b$$
$$L_b' = 0.71(jL_T - R_T) = L_b - 0.71R_f + 0.71jL_f$$
$$R_b' = 0.71(L_T - jR_T) = R_b + 0.71L_f - 0.71jR_f \qquad (1)$$

To develop an equation for the signal $L_f''$ at output terminal 115, assume that the partially decoded signals are utilized as the enhancement signals (this alternative having been previously referred to) as could be accomplished by coupling the outputs of matrix 100 to the appropriate ones of the variable gain amplifiers 121 through 124. In such case, the outputs of variable gain amplifiers 121 through 124, respectively, can be represented as $K_1L_f'$, $K_2R_f'$, $K_3L_b'$ and $K_4R_b'$. Considering the inputs to adder 111 we have $L_f'$, $K_3L_b'$ shifted by 90°, and $K_4R_b'$ shifted by 180°. Using standard phasor notation the 90° shift is achieved by multiplying by $j$ and the 180° shift is achieved by a sign reversal, so the output at terminal 115 can be represented as:

$$L_f'' = L_f' + jK_3L_b' - K_4R'$$

Using the above-established criterion to obtain the appropriate phase of the amplified enhancement signals applied to the other adders 112, 113, and 114, similar equations can be developed for $R_f''$, $L_b''$, and $R_b''$, the full set of equations being as follows:

$$L_f'' = L_f' + jK_3L_b' - K_4R_b'$$
$$R_f'' = R_f' + K_3L_b' - jK_4R_b'$$
$$L_b'' = L_b' - jK_1L_f' + K_2R_f'$$
$$R_b'' = R_b' - K_1L_f' + jK_2R_f' \qquad (2)$$

Comparison of these equations with equations (1) reveals that, by design, the second and third terms of the equations (2) are opposite in polarity to the subdominant components of equations (1).

To illustrate the type of improvement achieved using the present invention, assume that at a given moment of a musical program the right back signal is strongly predominant. Equations (1) show that using a conventional SQ decoder the decoded signal $R_b'$ includes $R_b$ in dominant proportion, so the $R_b$ signal would emanate most strongly from the right back speaker, as is desired. However, the decoded signals $L_f'$ and $R_f'$ also include $R_b$, although in subdominant proportion, so the $R_b$ signal will emanate from the front speakers and somewhat dilute the desired directional separation. Using known "logic" control techniques it is possible to boost the output level of the right back speaker (upon sensing its dominance) and simultaneously lower the output level of other speakers, but this technique has been found to sometimes cause undesirable mislocation of sounds at the boosted speaker. Consider now the results of the same hypothetical and the resultant operation of equations (2). To simplify the analysis, assume that the hypothetical condition results in $K_4 = 0.71$ ($K_4$ is the control signal for $R_b$) with the other K's at or near zero. The signal $R_b''$, which is fed to the right back speaker, includes $R_b$ so, as before, the $R_b$ signal will emanate most strongly from the right back speaker. In the present case, though, the spurious appearance of an $R_b$ component in the front speakers is eliminated as can be seen by examining the equations for $L_f''$ and $R_f''$. $L_f''$ is seen to include $L_f'$ which, in turn, includes the subdominant component $0.71R_b$. However, the term $-K_4R_b'$ in the equation for $L_f''$ includes $-K_4R_b$ which equals $-0.71R_b$ when $K_4$ is 0.71. Thus, the terms containing $R_b$ cancel in the expression for $L_f''$. Similarly, $R_f''$ is seen to include $R_b'$ which, in turn, includes the subdominant component $0.71jR_b$. But the term $-jK_4R_b'$ in the equation for $R_f''$ includes $-jK_4R_b$ which equals $-0.71jR_b$ when $K_4$ is 0.71. Therefore, the terms containing $R_b$ cancel in the expression for $R_f''$. The signal $L_b''$ includes $L_b'$ which, under the SQ code, contains no $R_b$ component, so it is seen that in the present hypothetical case only $R_b''$ will include the input signal $R_b$ while the remaining output signals, $L_f''$, $R_f''$ and $L_b''$, will have no $R_b$ component. This means that the $R_b$ signal will emanate only from the right back channel, the desired result. Also, if lower level signals are present in the $L_f$, $R_f$ or $L_b$ inputs, these need not be substantially mislocated to the right back speaker upon reproduction. This hypothetical could have been developed equally well by assuming the dominant sound to be positioned at the $L_b$, $L_f$ or $R_f$ inputs.

The equations (2) are useful in demonstrating the basic operation of the invention, but don't provide for the possible alteration of overall signal level caused by the described selective cancellation. Also, the control signals needed for these equations are not conveniently normalized. Accordingly, the following set of equations, similarly resulting from the stated general criteria, is set forth:

$$L_f'' = 0.71[(1 + 0.41K_1)L_f' + 0.71K_3jL_b' - 0.71K_4R_b']$$

$$R_f'' = 0.71[(1 + 0.41K_2)R_f' + 0.71K_3L_b' - 0.71K_4jR_b']$$

$$L_b'' = 0.71[(1 + 0.41K_3)L_b'' - 0.71K_1jL_f' + 0.71K_2R_f']$$

$$R_b'' = 0.71[(1 + 0.41K_4)R_b' - 0.71K_1L_f' + 0.71K_2jR_f'] \quad (3)$$

Aside from the various 0.71 coefficients, the difference of these equations from equations (2) is that the first term is multiplied by the factor $(1 + 0.41K)$. This factor is introduced to retain overall signal level in a desirable fashion. For example, assume that at a given moment the right back input signal is strongly predominant, resulting in $K_4$ being relatively high and the other K's being relatively low. As previously explained, this will cause selective cancellation of the $R_b$ signal from the outputs $L_f''$ and $R_f''$, which can be seen from the last terms of the equations for these outputs. Accordingly, and since the degree of such cancellation depends on the magnitude of $K_4$, the $R_b'$ component of $R_b''$ is increased in proportion to $K_4$. Similar examples could be set forth to illustrate the propriety of the other $(1 + 0.41K)$ factors. The $(1+0.41K)$ factors are represented functionally in FIG. 3 by the variable gain amplifiers 105 through 108.

By substituting from the relationships of equations (1), the equations (3) can be rewritten in the following form which is useful in visualizing certain implementations of the invention:

$$L_f'' = 0.71[(1 + 41K_1)L_T - 0.5K_3(jR_T + L_T) - 0.5K_4(L_T - jR_T)]$$

$$R_f'' = 0.71[(1 + 41K_2)R_T + 0.5K_3(jL_T - R_T) - 0.5K_4(R_T + jL_T)]$$

$$L_b'' = 0.71[(1 + 0.41K_3)0.71(jL_T - R_T) - 0.71K_1jL_T + 0.71K_2R_T]$$

$$R_b'' = 0.71[(1 + 0.41K_4)0.71(L_T - jR_T) - 0.71K_1L_T + 0.71K_2jR_T] \quad (4)$$

For purposes of both sets of equations (3) and (4), the K's are defined as each having a range between zero and unity and the sum of the K's must be less than or equal to unity; that is:

$$0 \leq K_N \leq 1$$

$$0 \leq K_1 + K_2 + K_3 + K_4 \leq 1$$

The equations (3) and (4) have basic characteristics which correspond to the previously developed equations (2). Initially, it can be observed that when all K's are zero the equations (3) and (4) reduce to the conventional SQ equations (1). To illustrate the operation of the equations (3) and (4) in a specific situation, assume that at a given moment of a musical program only the left front signal is present. The SQ encoder questions are:

$$L_T = L_f + 0.71R_b - 0.71jL_b$$

$$R_T = R_f - 0.71L_b + 0.71jR_b$$

When only $L_f$ is present, these equations reduce to:

$$L_T = L_f$$

$$R_T = O$$

Upon receiving these composite signals the control signal generator 300 will generate the control signals $K_1 = 1$, $K_2 = K_3 = K_4 = 0$. Substituting these values into equations (4), the outputs at terminals 115 through 118 would be as follows:

$$L_f'' = 0.71[(1 + 0.41)L_T] = L_T = L_f$$

$$R_f'' = 0.71[(1 + 0)R_T] = 0.71R_T = 0$$

$$L_b'' = 0.71[(1 + 0)0.71(jL_T) - 0.71jL_T] = 0$$

$$R_b'' = 0.71[(1 + 0)0.71(L_T) - 0.71L_T] = 0$$

These outputs indicate that the decoder will produce the signal $L_f$ at the left front output terminal and no signal at the other output terminals, a result which duplicates the input conditions. As a further illustration, assume now that the left front signal is strongly predominant but that there exists a second weaker signal, say, at the right front input. In this case the encoder equations will be:

$$L_T = L_f$$

$$R_T = R_f$$

With $L_f$ strongly predominant, the control signal generator will again generate control signals substantially as $K_1 = 1$, $K_2 = K_3 = K_4 = 0$. Thus, equations (4) yield the following result:

$$L_f'' = 0.71[(L + 0.71)L_T] = L_T = L_f$$

$$R_f'' = 0.71[(1 + 0)R_T] = 0.71R_T = 0.71R_f$$

$$L_b'' = 0.71[0.71(jL_T - R_T) - 0.71jL_T] = -0.5R_T = -0.5R_f$$

$$R_b'' = 0.71[0.71(L_T - jR_T) - 0.71L_T] = -0.5jR_T = -0.5jR_f$$

Again, the predominant signal, $L_f$, is fully "separate"; i.e., it appears only in the left front output. The weaker $R_f$ signal appears at all other channels. This is characteristic of the present decoding apparatus which tends to position signals that are "vectorially orthogonal" to the predominant signal at all outputs at which the predominant signal does not appear. In the present example the predominant signal ($L_f$) is in the composite signal $L_T$. The other composite signal, $R_T$, is vectorially orthogonal to $L_T$ as can best be visualized by remembering that the two channels carrying the composite signals are independent (typically modulating orthogonal walls of a record groove). Therefore, in order for $L_f$ (which is $L_T$ in this case) to be fully separate at the left front output, it stands to reason that $R_T$ (alone) must appear at all other outputs.

In any encoded program there will typically be a number of input signals and the relative directional predominance of such signals will vary. To further illustrate the operation, let us expand the previous example to one wherein the left front signal is again strongly predominant, but there exist weaker signals at the right front, right back and left back input positions. In such case the encoder equations are:

$$L_T = L_f + 0.71R_b - 0.71jL_b$$

$$R_T = R_f - 0.71L_b + 0.71jR_b$$

Again, control signal generator 500 will generate control signals substantially as $K_1 = 1$, $K_2 = K_3 = K_4 = 0$. The outputs are obtained from equations (4) as follows:

$$L_f'' = 0.71[(1 + 0.41)L_T] = L_T = L_f + 0.71R_b - 0.71jL_b$$

$$R_f'' = 0.71[(L + 0)R_T] = 0.71R_T = 0.71R_f - 0.5L_b + 0.5jR_b$$

$$L_b'' = 0.71[0.71(jL_T - R_T) - 0.71jL_T] = -0.5R_T = -0.5R_f + 0.35L_b - 0.35jR_b$$

$$R_b'' = 0.71[0.71(L_T - jR_T) - 0.71L_T] = -0.5jR_T = -0.5jR_f + 0.35jL_b + 0.35R_b$$

Figures 4A, 4B, 4C, 4D:
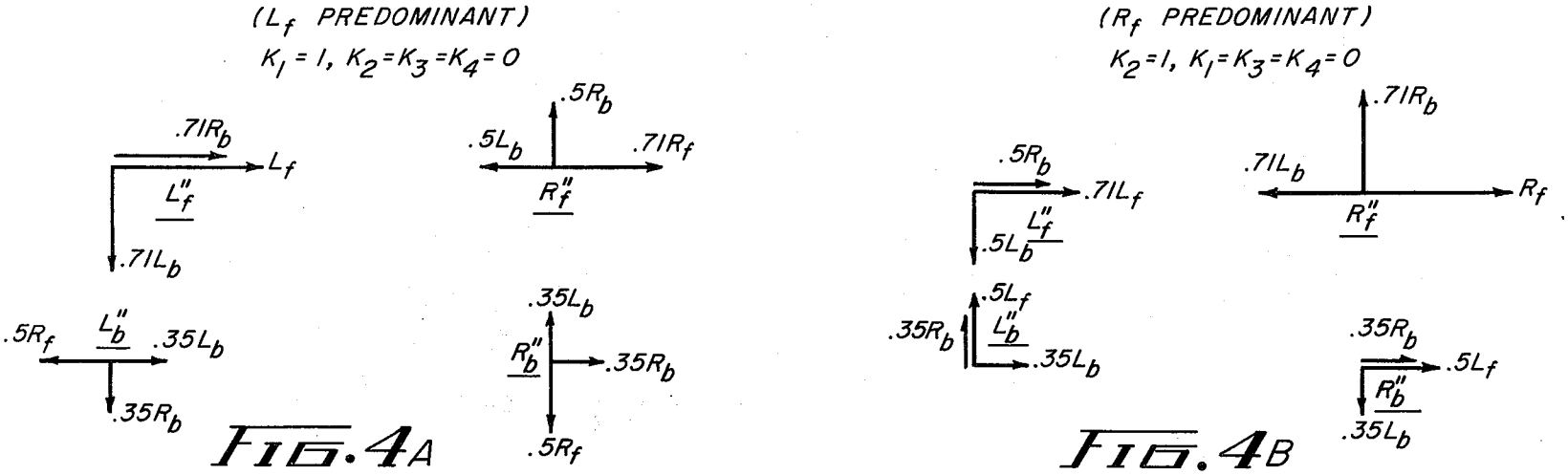
FIGS. 4A through 4D are phasor diagrams which are helpful in describing the relative phase orientation of the outputs of the invented decoder in certain situations.

The outputs are shown at their respective relative positions in the phasor diagram of FIG. 4A. As before, since $L_T$ contains the predominant signal ($L_f$), the vectorially orthogonal $R_T$ appears in various relative orientations at all outputs other than the left front output. The predominant signal $L_f$ is fully separate in the left front output. Also, there is no overall RMS power alternation of the input signals. FIGS. 4B, 4C and 4D show the phasor diagrams for similar hypothetical situations but where different ones of the input signals are strongly predominant. The results for each situation can be seen to be analogous to the results described in conjunction with FIG. 4A. While illustrative examples wherein a single input signal is strongly predominant are most useful in describing operation of the invention, it will be appreciated that in many practical situations varying degrees of directional predominance will exist simultaneously with the result that more than one control signal will have a value greater than zero. In such cases the equations (3) or (4) apply equally well, with the degree of separateness of each individual signal being a function of its relative directional predominance.

Figure 5:
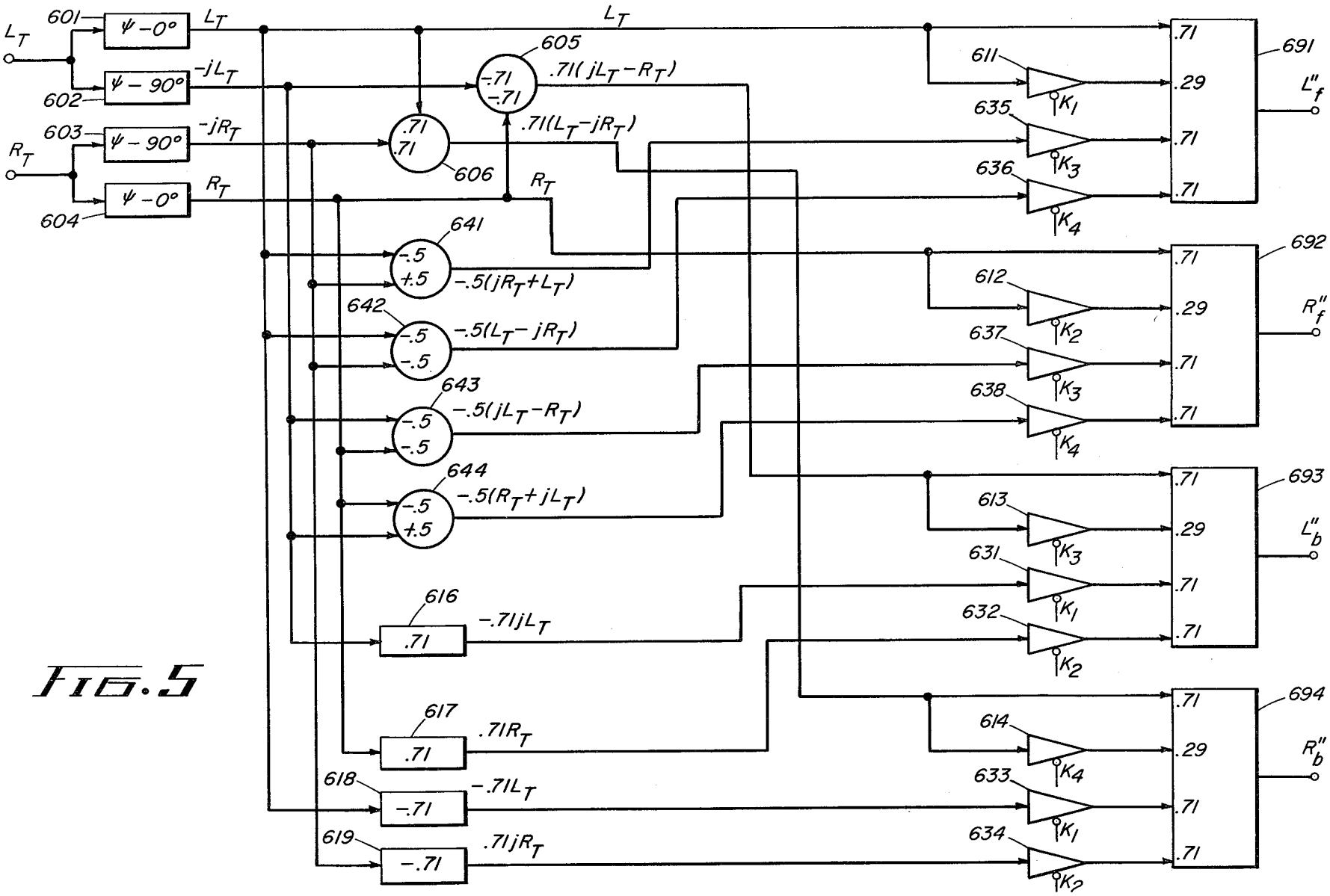
FIG. 5 is a block diagram of an apparatus in accordance with an embodiment of the invention.

FIG. 5 shows an embodiment of the invention wherein the individual terms of each equation (4) are effectively formed by one of four final summing circuits designated 691, 692, 693 and 694. The composite signals, $L_T$ and $R_T$ are applied, as shown, to all-pass phase shift networks 601, 602, 603 and 604, which comprise a portion of a conventional SQ decoder (e.g. phase shift networks 74, 76, 78 and 80 of FIG. 2). Using conventional phasor notation, the outputs of these four networks can be designated as $L_T$, $-jL_T$, $-jR_T$ and $R_T$, respectively. Summing circuits 605 and 606 are employed (in the manner of summing circuits 86 and 90 of FIG. 2) to obtain outputs which can be designated $(jL_T - R_T)$ and $(L_T - jR_T)$, respectively. The signals $L_T$, $R_T$, $(jL_T - R_T)$ and $(L_T - jR_T)$ are respectively applied, with a weighting factor of 0.71, to a first input terminal of the summing circuits 691, 692, 693 and 694. These signals are also respectively applied to variable gain amplifiers 611, 612, 613 and 614, which are respectively gain controlled by the signals $K_1$, $K_2$, $K_3$ and $K_4$ (from control signal generator 500). The outputs of amplifiers 611, 612, 613 and 614 are respectively applied, with a weighting factor of 0.29, to a second input terminal of the summing circuits 691, 692, 693 and 694. The sum of the inputs at the first and second input terminals of the adders 691 through 694 can thus be expressed as $(0.71 + 0.29K_1)L_T$, $(0.71 + 0.29K_2)R_T$, $(0.71 + 0.29K_3)\ 0.71(jL_T - R_T)$ and $(0.71 + 0.29K_4)0.71(L_T - jR_T)$, respectively. These four terms are seen to correspond respectively with the first terms of the equations (4), assuming the equations were expanded to include the multiplying factor of 0.71.

The signals $L_T$, $-jL_T$, $-jR_T$ and $R_T$ are also applied, respectively, to attenuators 616 and 617 and inverting attenuators 618 and 619, all of the attenuators introducing a factor of 0.71. The outputs of attenuators 616 and 617 are respectively applied to the variable gain amplifiers 631 and 632 which are respectively gain controlled by the signals $K_1$ and $K_2$. The outputs of gain control amplifiers 631 and 632 are respectively applied to third and fourth input terminals of summing circuit 693 with weighting factors of 0.71. The sum of the inputs at these third and fourth terminals is therefore $0.71(-0.71K_1jL_T + 0.71K_2R_T)$ which can be seen to correspond to the last two terms of the equation (4) for $L_b''$. In similar fashion, the outputs of inverting attenuators 618 and 619 are coupled via variable gain amplifiers 633 and 634 to third and fourth input terminals of summing circuit 694 with weighting factors of 0.71. The amplifiers 633 and 634 are gain controlled by the signals $K_1$ and $K_2$, so the sum of the inputs at the third and fourth input terminals of summing circuit 694 is $0.71(-0.71K_1L_T + 0.7K_2jR_T)$ which can be seen to correspond to the last two terms of the equation (4) for $R_b''$.

The signals $L_T$, $-jL_T$, $-jR_T$ and $R_T$ are also applied, as shown, to selected ones of four summing circuits designated by the reference numerals 641, 642, 632 and 644. Circuit 641 adds $-0.5$ part of $L_T$ to 0.5 part of $-jR_T$ to form the signal $-0.5(jR_T + L_T)$. Circuit 642 adds $-0.5$ part of $L_T$ to $-0.5$ part of $-jR_T$ to form the signal $-0.5(L_T - jR_T)$. Circuit 643 adds $-0.5$ part of $-jL_T$ to $-0.5$ part of $R_T$ to form the signal $0.5(jL_T - R_T)$. Circuit 644 adds $-0.5$ part of $R_T$ to 0.5 part of $-jL_T$ to form the signal $-0.5(R_T + jL_T)$. The outputs of summing circuits 641, 642, 643 and 644 are respectively applied to variable gain amplifiers 635, 636, 637 and 638 which are respectively gain controlled by the signals $K_3$, $K_4$, $K_3$ and $K_4$. The outputs of gain control amplifiers 635 and 636 are respectively applied to the third and fourth input terminals of summing circuit 691 with weighting factors of 0.71. The sum of the inputs at these third and fourth terminals is therefore $0.71[-0.5K_3\ (jR_T + L_T) - 0.5K_4\ (L_T - jR_T)]$ which corresponds to the last two terms of the equation (4) for $L_f''$.

The outputs of gain control amplifiers 637 and 638 are respectively applied to the third and fourth input terminals of summing circuit 692 with weighting factors of 0.71. The sum of the inputs at these third and fourth terminals is $0.71[0.5K_3\ (jL_T - R_T) - 0.5K_4\ (R_T + jL_T)]$ which can be seen to correspond to the last two terms of the equation (4) for $R_f''$.

Figure 6:
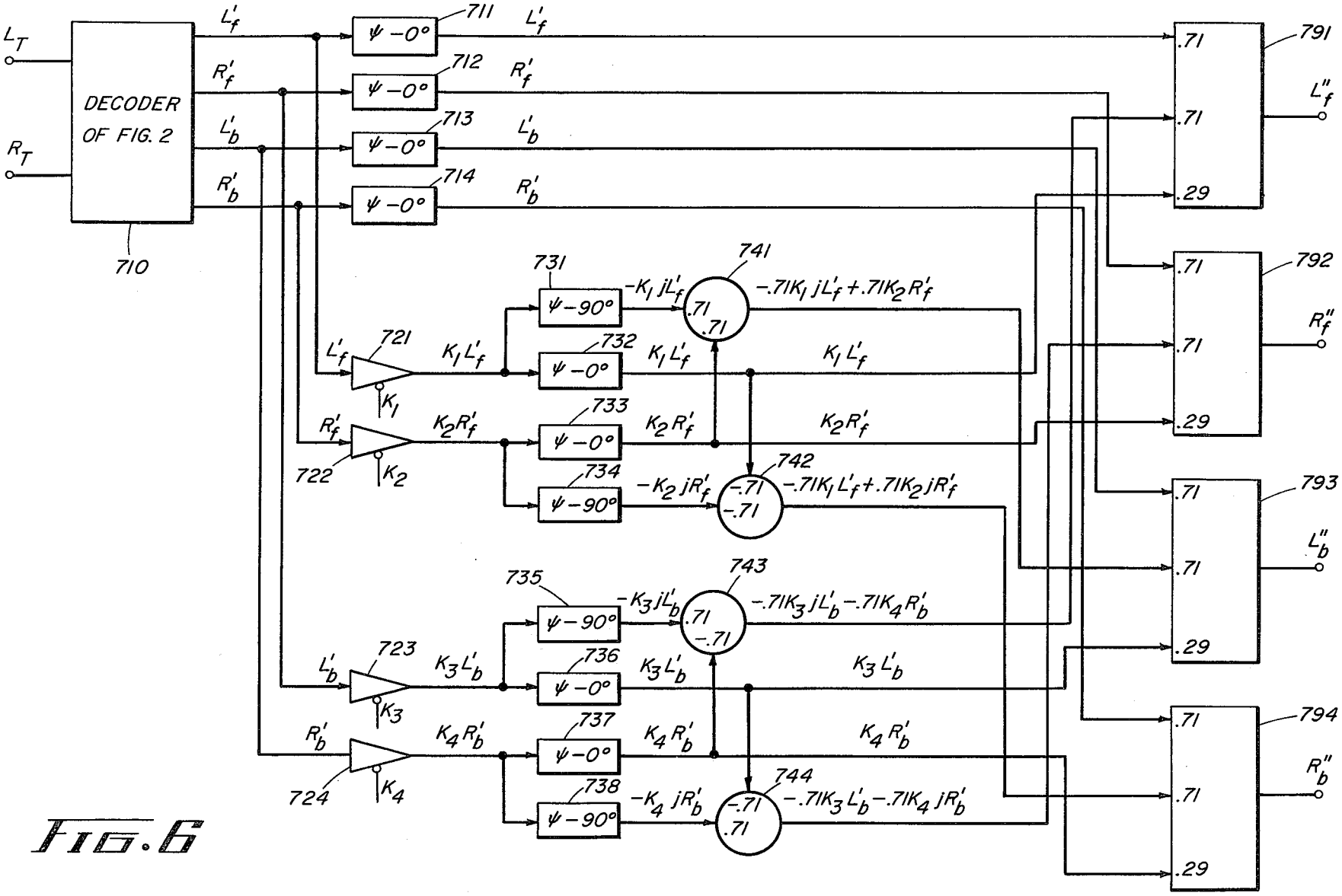
FIG. 6 is a block diagram of an apparatus in accordance with another embodiment of the invention.

FIG. 6 shows another embodiment of the invention that can be best understood in terms of the equations (3). For convenience, the equations (3) are expanded into the following form:

$$L_f'' = 0.71L_f' + 0.29K_1L_f' + 0.71(0.71K_3jL_b' - 0.71K_4R_b')$$

$$R_f'' = 0.7R_f' + 0.29K_2R_f' + 0.71(0.71K_3L_b' - 0.71K_4jR_b')$$

$$L_b'' = 0.71L_b' + 0.29K_3L_b' + 0.71(-0.71K_1jL_f' + 0.71K_2R_f')$$

$$R_b'' = 0.71R_b' + 0.29K_4R_b' + 0.71\ (-0.71K_1L_f' + 0.71K_2jR_f') \qquad (5)$$

In FIG. 6 the signals $L_f''$, $R_f''$, $L_b''$and $R_b''$are effectively formed by four summing circuits designated 791, 792, 793, and 794. Each of these summing circuits has three input terminals which respectively receive signals that correspond to the three terms of each equation 5. The appropriate signals are formed as follows: The composite signals $L_T$ and $R_T$ are applied to a conventional SQ decoder 710 which may be of the type described in conjunction with FIG. 2. The outputs of decoder 710, designated $L_f'$, $R_f'$, and $R_b'$ are coupled through reference all-pass phase shift networks 711 through 714, respectively, to the first input terminals of summing circuits 791 through 794, respectively. These signals are applied to the summing circuits with a weighting factor of 0.71 and account for the first terms of each of the equations (5). The reference phase shifters 711 introduce a reference phase shift $\psi$ and are utilized to maintain phase coherence with other signals (ultimate inputs to the summing circuits 791 through 794) that will necessarily experience reference phase shifts. The outputs of decoder 710 are also respectively coupled to the inputs of variable gain amplifiers 721 through 724, the gains of these amplifiers being respectively controlled by the signals $K_1$, $K_2$, $K_3$ and $K_4$. The output of each variable gain amplifier is coupled to a pair of all-pass phase shift networks, one of the pair introducing a reference phase shift of $\psi$ and the other of the pair introducing a phase shift of $(\psi - 90°)$. These eight phase shifters are labeled with the reference numerals 731 through 738. The phase shift networks 732, 733, 736 and 737 introduce a reference phase shift of $\psi$ and the outputs of these networks, which can be respectively represented as $K_1L_f'$, $K_2R_f'$, $K_3L_b'$and $K_4R_b'$, are coupled to the second input terminals of the summing circuits 791 through 794, respectively, each being applied with a weighting factor of 0.29. These inputs can be seen to correspond to the second terms of each of the equations 5. Using conventional phasor notation, the outputs of the phase shift networks 731, 734, 735 and 738 can be respectively represented as $-K_1jL_f'$, $-K_2jR_f'$, $-K_3jL_b'$, and $K_4jR_b'$. A .71 part of the output of network 731 is coupled to a 0.71 part of the output of network 733 by a summing circuit 741 to produce an output that can be represented as $-0.71K_1jL_f' + 0.71K_2R_f'$. A $-0.71$ part of the output of network 732 is added to a $-0.71$ part of the output of network 734 by a summing circuit 742, the output of which may be represented as $-0.71K_1L_f' + 0.71K_2jR_f'$. A 0.71 part of the output of network 735 is added to a $-0.71$ part of the output of network 737 by a summing circuit 743, the output of which may be represented as $-0.71K_3jL_b' - 0.71K_4R_b'$. Also, a $-0.71$ part of the output of network 736 is added to 0.71 part of the output of network 738 by a summing circuit 744 whose output may be expressed as $-0.71K_3L_b' - 0.71K_4jR_b'$. The outputs of summing circuits 741, 742, 743 and 744 are respectively applied to third input terminals of the summing circuits 791, 792, 793 and 794, each being applied with a weighting factor of 0.71. It will be recognized that these inputs correspond to the third terms of each of the equations (5), so that the outputs of the summing circuits, viz. $L_f''$, $R_f''$, $L_b''$ and $R_b''$, corresponds to the expressions set forth in the equations (5). correspond The embodiment of FIG. 6 can be viewed in terms of the generalized functional block diagram of FIG. 3 by considering the enhancement signals as the inputs to the variable gain amplifiers 721 through 724 (corresponding to variable gain amplifiers 121 through 124 of FIG. 3). The function of the phase shifters 131 through 138 (FIG. 3) is effectively performed by the all-pass phase shift networks 731 through 738 in conjunction with appropriate polarity changes introduced by the summing circuits 741 through 744. As previously described in conjunction with FIG. 3, these elements operate to apply the enhancement signals at the appropriate relative phases necessary to cause selective cancellation in accordance with the principles of the invention. The embodiment of FIG. 5 can also be viewed in terms of the generalized functional block diagram of FIG. 3 by considering that the enhancement signals are the outputs of the summing circuits 641 through 644 and the attenuators 616 through 619. In this instance the functions of the phase shifters 131 through 138 are performed by these summing circuits and attenuators which orient the enhancement signals at the appropriate relative phase for selective cancellation. Also, in this instance, the variable gain amplifiers operate on signals which are already phase shifted, the order of these operations generally being a matter of convenience or choice.

From the foregoing it will be appreciated that there are numerous ways in which the enhancement signals can be generated and applied in accordance with the invention. For example, it can be readily demonstrated that the equations (4) can be manipulated into the following form:

$$L_f'' = L_l - (0.15 - 0.15K_1 + 35K_3)\ (jR_T + L_T) - (0.15 - 0.5K_1 + 35K_4)\ (L_l - jR_T)$$

$$R_f'' = R_l - (0.15 - 0.5K_2 + 0.35K_3)\ (jL_l - R_T) - (0.15 - 0.15K_2 + 0.35K_4)\ (R_l + jL_T)$$

$$L_b'' = 0.71(jL_l - R_T) - (0.21 - 0.21K_3 + 0.5K_1)jL_l + (0.21 - 0.21K_3 + 0.5K_2)\ R_l$$

$$R_b'' = 0.71(L_l - jR_T) - (0.21 - 0.21K_4 + 0.5K_1)L_l + (0.21 - 0.21K_4 + 0.5K_2jR_l$$

Figure 7:
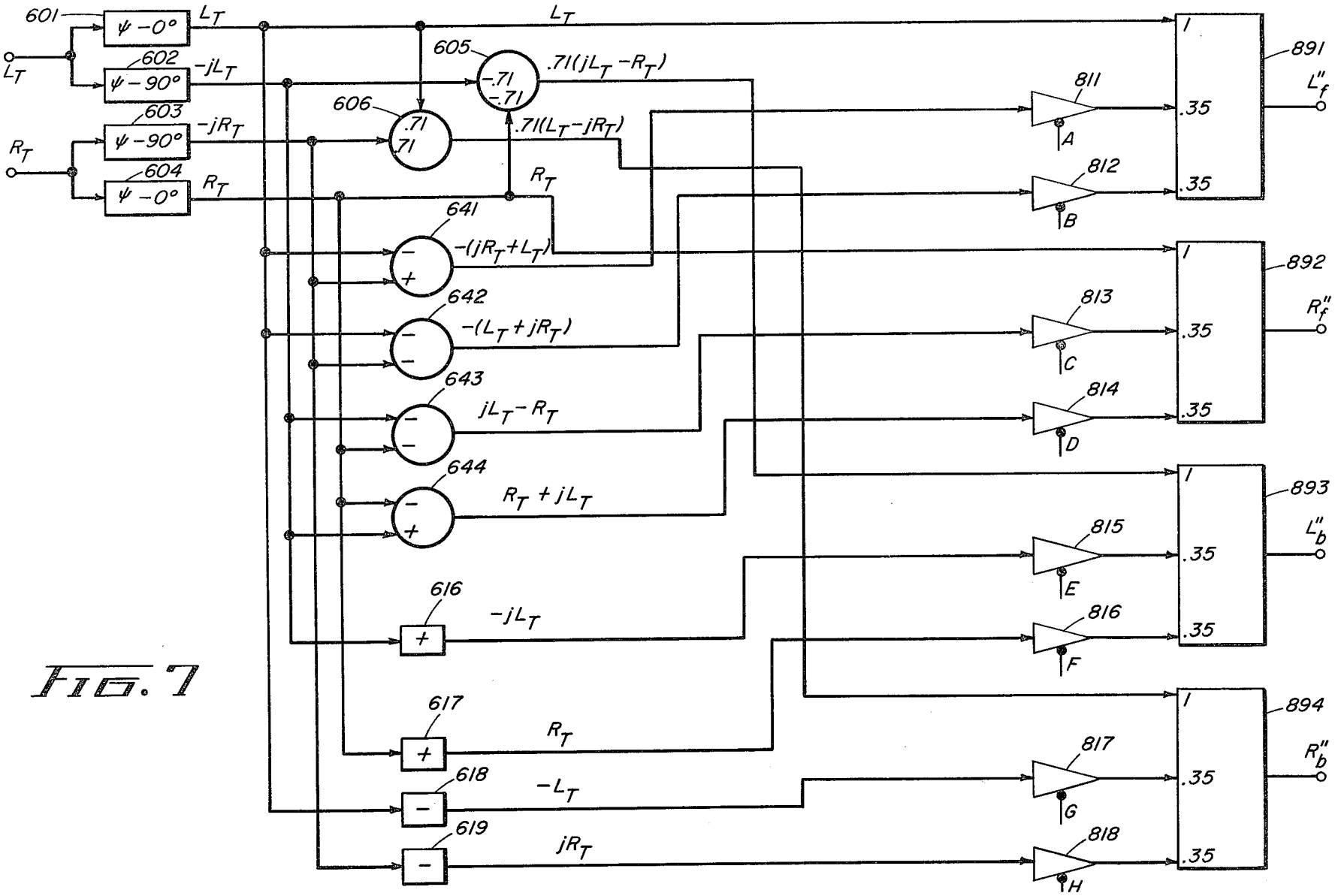
FIG. 7 is a block diagram of an apparatus in accordance with still another embodiment of the invention.

The equations (6) are convenient for visualizing the operation of an embodiment illustrated in FIG. 7 which is somewhat similar to FIG. 5 but modified to reduce the number of variable gain amplifiers from 12 to eight. The units labeled 601 through 606, 641 through 644 and 616 through 619 are configured and operate as in FIG. 5, except that the coefficients of the units 641 through 644 and 616 through 619 are all of unity magnitude. In this embodiment the individual terms of each equation (6) are effectively formed by one of four final summing circuits designated 891, 892, 893 and 894. As in FIG. 5, the outputs of the units 601, 605, 606 and 604 are respectively applied to the appropriate ones of these final summing circuits, but in the present instance each is applied with a unity weighting factor. The outputs of units 641 through 644 and 616 through 619 are respectively applied to the variable gain amplifiers 811 through 818 which are respectively controlled by signals designated A, B, C, D, E, F, G, and H.

Figure 8:
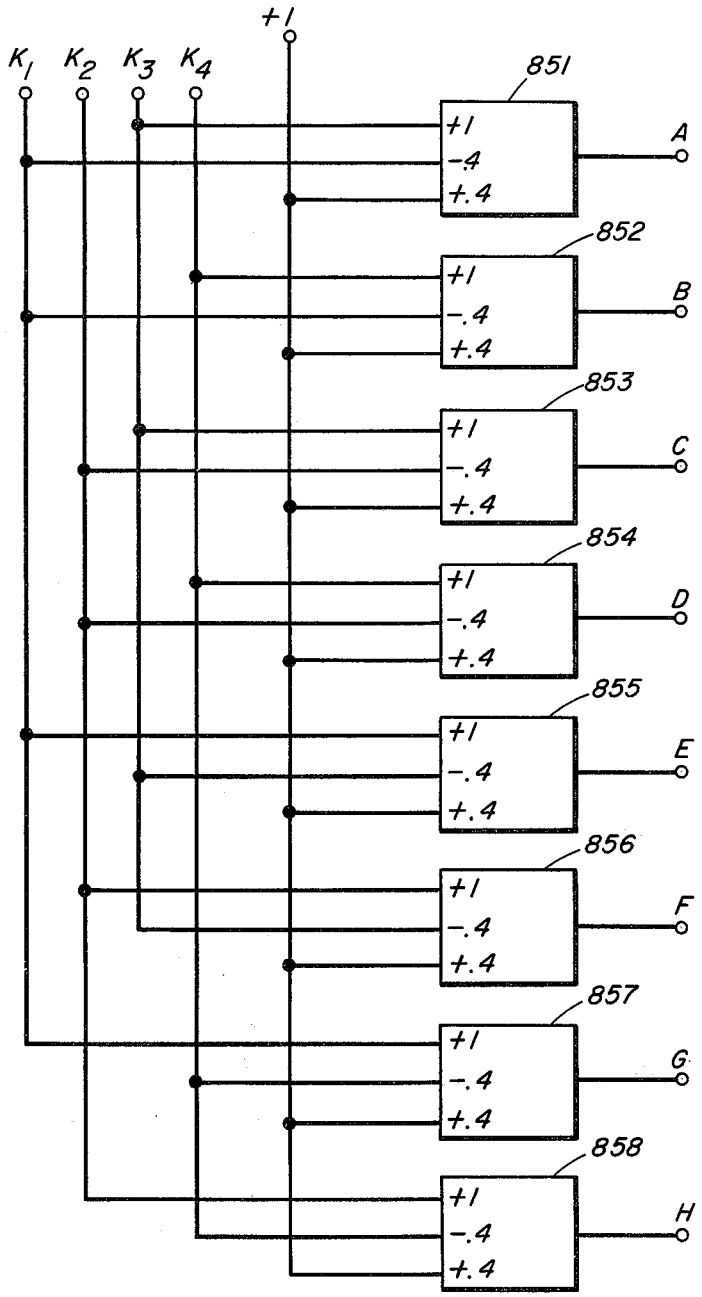
FIG. 8 is a block diagram of circuitry useful for generating signals employed in the embodiment of FIG. 7.

FIG. 8 illustrates the manner in which the control signals A through H can be generated from the previously developed control signals $K_1$, $K_2$, $K_3$and $K_4$. Eight summing circuits, labeled 851 through 858 are used to form appropriate combinations of the K's in conjunction with a fixed voltage level which represents a coefficient of +1. The outputs, A through H, can be expressed as follows:

$$A = K_3 - 0.4K_1 + 0.4$$

$$B = K_4 - 0.4K_1 + 0.4$$

$$C = K_3 - 0.4K_2 + 0.4$$

$$D = K_4 - 0.4K_2 + 0.4$$

$$E = K_1 - 0.4K_3 + 0.4$$

$$F = K_2 - 0.4K_3 + 0.4$$

$$G = K_1 - 0.4K_4 + 0.4$$

$$H = K_2 - 0.4K_4 + 0.4$$

Referring again to FIG. 7, the outputs of gain control amplifiers 811 and 812, 813 and 814, 815 and 816, and 817 and 818 are respectively applied to summing circuits 891, 892, 893 and 894, each with a weighting factor of 0.35. The outputs of these summing circuits can be seen to correspond with the expressions set forth in equations (6). For example, the three inputs to summing circuit 891 are $L_l$, $0.35A[-(jR_T + L_T)] = -(0.35K_3 - 0.15K_1 + 0.15)(jR_T + L_T)$, and $0.35B[-(L_T + jR_T)] = -(0.35K_4 - 0.15K_1 = 0.15)(L_T + jR_T)$, which correspond to the three terms of the equation (6) for $L_f''$. Thus it is seen that by judiciously combining the K's the desired result can be obtained using only four all-pass phase shift networks and eight variable-gain amplifiers.

We claim:

1. Apparatus for decoding first, second, third and fourth individual audio signals to the extent they are contained in first and second composite signals, the first composite signal containing the first individual audio signal in dominant proportion and two other individual audio signals in subdominant proportions and the second composite signal containing the second individual audio signal in dominant proportion and two other individual audio signals in subdominant proportions, comprising:

a. means for measuring the degree of directional predominance of each of said four individual audio signals;

b. first, second, third and fourth output terminals;

c. means responsive to said first and second composite signals for forming first, second, third and fourth partially decodedd signals, each of said partially decoded signals including a different one of the individual audio signals in dominant proportion and two other individual audio signals in subdominant proportion;

d. means for applying said first, second, third and fourth partially decoded signals to said first, second, third and fourth output terminals, respectively, each being applied at a level which depends on the degree of directional predominance of its principal component;

e. means responsive to said first and second composite signals for forming first, second, third and fourth enhancement signals, each of said enhancement signals having a different one of said individual audio signals as its principal component; and f. means for applying each of said enhancement signals to the particular ones of said output terminals at which its principal component is present in subdominant proportion, each of said enhancement signals being applied at a relative phase which is the opposite of said signal present in subdominant proportion and at a level which depends on the measured degree of directional predominance of its principal component.

2. Apparatus as defined by claim 1 wherein said first, second, third and fourth enhancement signals correspond to said first, second, third and fourth partially decoded signals, respectively.

3. Apparatus as defined by claim 1 wherein said means for applying said enhancement signals includes a plurality of gain control amplifiers.

4. Apparatus for decoding first, second, third and fourth individual audio signals to the extent they are contained in first and second composite signals, the first composite signals containing the first individual audio signals in dominant proportion and two other individual audio signals in subdominant proportions and the second composite signal containing the second individual audio signal in dominant proportion and two other individual audio signals in subdominant proportions, comprising:

a. means for measuring the degree of directional predominance of each of said four individual audio signals and for generating control signals which are a measure of such directional predominance;

b. first, second, third and fourth output terminals;

c. means responsive to said first and second composite signals for forming first, second, third and fourth partially decoded signals, each of said partially decoded signals including a different one of the individual audio signals in dominant proportion and two other individual audio signals in subdominant proportion;

d. means for applying said first, second, third and fourth partially decoded signals to said first, second, third and fourth output terminals, respectively, each being applied at a level which depends on the control signal associated with its individual audio signal of dominant proportion;

e. means responsive to said first and second composite signals for forming first, second, third and fourth enhancement signals, each of said enhancement signals having a different one of said individual audio signals as its principal component; and f. means for applying each of said enhancement signals to the particular ones of said output terminals at which its principal component is present in subdominant proportion, each of said enchancement signals being applied at a relative phase which is the opposite of said signals present in subdominant proportion and at a level which is a function of the control signal associated with its principal component.

5. Apparatus as defined by claim 4 wherein said means for applying said enhancement signals includes a plurality of gain control amplifiers which are controlled by said control signals.

6. Apparatus as defined by claim 4 wherein said first, second, third and fourth enhancement signals correspond to said first, second, third and fourth partially decoded signals, respectively.

7. A method of decoding first, second, third and fourth individual audio signals to the extent they are contained in first and second composite signals, the first composite signal containing the first individual audio signal in dominant proportion and two other individual audio signals in subdominant proportions and the second composite signal containing the second individual audio signal in dominant proportion and two other individual audio signals in subdominant proportions, comprising the steps of:

a. measuring the degree of directional predominance of each of said four individual audio signals;

b. forming first, second, third and fourth partially decoded signals, each of said partially decoded signals including a different one of the individual audio signals in dominant proportion and two other individual audio signals in subdominant proportion;

c. applying said first, second, third and fourth partially decoded signals to first, second, third and fourth output terminals, respectively, each being applied at a level which depends on the degree of directional predominance of its principal component;

d. forming first, second, third and fourth enhancement signals, each of said enhancement signals having a different one of said individual audio signals as its principal component; and e. applying each of said enhancement signals to the particular ones of said output terminals at which its principal component is present in subdominant proportion, each of said enhancement signals being applied at a relative phase which is the opposite of said signal present in subdominant proportion and at a level which depends on the measured degree of directional predominance of its principal component.

8. Apparatus for decoding first, second, third and fourth individual audio signals to the extent they are contained in first and second composite signals, the first composite signal containing the first individual audio signal in dominant proportion and two other individual audio signals in subdominant proportions and the second composite signal containing the second individual audio signal in dominant proportion and two other individual audio signals in subdominant proportions, comprising:

a. means for generating four control signals which are a measure of the degree of directional predominance of the four individual audio signals, respectively;

b. first, second, third and fourth output terminals;

c. means for generating eight combination control signals by forming weighted differences between said four control signals;

d. means responsive to said first and second composite signals for forming first, second, third and fourth partially decoded signals, each of said partially decoded signals including a different one of the individual audio signals in dominant proportion and two other individual audio signals in subdominant proportion;

e. means for applying said first, second, third and fourth partially decoded signals to the first, second, third and fourth output terminals, respectively;

f. means responsive to said first and second composite signals for forming eight enhancement signals, two each of said enhancement signals having a different one of said individual audio signals as its principal component; and g. means for applying each of said enhancement signals to the particular ones of said output terminals at which its principal component is present in subdominant proportion, each of said enhancement signals being applied at a relative phase which is the opposite of said signal present in subdominant proportion and at a level which depends on the measured degree of directional predominance of its principal component; said means including eight gain control amplifiers responsive to said eight enhancement signals, the gain of each gain control amplifier being controlled by a different one of said combination control signals.

9. Apparatus as defined by claim 8 wherein said means for forming the first, second, third and fourth partially decoded signals comprises four all-pass phase shift networks and said means for forming the eight enhancement signals comprises a plurality of summing circuits.

10. Apparatus as defined by claim 8 wherein each of said partially decoded signals is applied to said output terminals at a level which depends on the control signal associated with its individual audio signal of dominant proportion.

* * * * *